US008424413B2

(12) United States Patent
Rutz

(10) Patent No.: US 8,424,413 B2
(45) Date of Patent: Apr. 23, 2013

(54) COUPLING MEANS, IN PARTICULAR FOR A FURNITURE ADJUSTMENT MEANS

(75) Inventor: Josef Rutz, Rosenheim (DE)

(73) Assignee: Steelcase Werndl AG, Rosenheim (DE)

( * ) Notice: Subject to any disclaimer, the term of this patent is extended or adjusted under 35 U.S.C. 154(b) by 402 days.

(21) Appl. No.: 12/777,547

(22) Filed: May 11, 2010

(65) Prior Publication Data

US 2010/0300239 A1 Dec. 2, 2010

(30) Foreign Application Priority Data

May 27, 2009 (EP) ..... 09 007 082

(51) Int. Cl.
*B60T 11/06* (2006.01)

(52) U.S. Cl.
USPC ..... 74/500.5; 74/501.6; 188/24.16

(58) Field of Classification Search ..... 74/500.5, 74/501.6, 502.4, 502.6; 108/6, 7, 128, 131; 248/459, 371, 398, 166; 188/24.16; 403/109.7; *B60T 11/06*
See application file for complete search history.

(56) References Cited

U.S. PATENT DOCUMENTS 4,057,127 A * 11/1977 Woodring ..... 188/24.16
4,811,620 A * 3/1989 Old et al. ..... 74/471 R
6,212,969 B1 * 4/2001 Kuo ..... 74/500.5
2003/0140724 A1 * 7/2003 Lee et al. ..... 74/501.6
2008/0178778 A1 7/2008 Koning et al.

FOREIGN PATENT DOCUMENTS

| | | |
|---|---|---|
| DE | 20 2006 013 998 | 11/2006 |
| EP | 0 572 770 | 1/1997 |
| EP | 1 159 887 | 10/2003 |
| EP | 1 308 109 | 8/2004 |

* cited by examiner

*Primary Examiner* — Richard Ridley
*Assistant Examiner* — Thomas Diaz
(74) *Attorney, Agent, or Firm* — Nixon & Vanderhye P.C.

(57) ABSTRACT

An adjustment mechanism for adjustable pieces of furniture is provided with a coupling including a transmission and sub-coupling structure, where the transmission and sub-coupling structure is constructed in such a way that at least one secondary transmission is always adjusted whether one primary transmission is actuated or whether the another primary transmission is actuated. At least two catch decouplers are provided in such a way that when the at least one primary transmission is adjusted, and disengaged by an adjustment of an associated actuator, the transmission and sub-coupling structure is always also entrained and adjusted, while one of the catch decouplers cooperates with the transmission and sub-coupling structure in such a way that the adjusting or pivoting transmission and sub-coupling structure leaves a second secondary transmission and/or the second actuator unchanged in position.

7 Claims, 14 Drawing Sheets

COUPLING MEANS, IN PARTICULAR FOR A FURNITURE ADJUSTMENT MEANS

This application is claims priority to EP Application No. 09007082.2 filed 27 May 2009, the entire contents of which is hereby incorporated by reference.

BACKGROUND OF THE INVENTION

The invention relates to a coupling means, in particular for a furniture adjustment means.

An adjustable piece of furniture is known from EP 0 572 770 B1 and EP 1 159 887 B1, for example. Each of these two prior publications discloses a folding table, comprising T-shaped bases which are arranged at the end face and support a work surface or table top. This table top is conventionally oriented horizontally in a work and use position.

This work surface or table top can be pivoted between the conventional, approximately horizontally oriented work and use position and an approximately vertical storage position.

A locking mechanism is therefore provided as an adjustment means and fixes the work surface in the conventional, approximately horizontal use position thereof. By contrast, if the work surface is to be pivoted into a space-saving storage position, the locking mechanism is actuated in such a way that said surface can be pivoted about a horizontal pivot axis into the approximately horizontal storage position thereof.

The locking mechanism can for example be disengaged using an actuation means, which is arranged of the underside of the table top directly alongside the longitudinal edge. If the table top is for example to be pivotable about a horizontal pivot axis in both directions, in such a way that the table top can be pivoted into the storage position thereof at any time independent of from which side a user approaches the table, it is expedient to provide an actuation and disengagement means, with which the locking mechanism can be released, alongside each of the two longitudinal sides of the table top on the underside.

SUMMARY OF THE INVENTION

The object of the invention is to provide an improved adjustment means, in particular for an adjustable piece of furniture.

In the context of the invention, a coupling means for adjusting pieces of furniture or furniture parts, in particular a locking and release means for pivotable table tops is provided, and may comprise a plurality of actuation means, for example two actuation means. In particular for a pivotable table top, at least one actuation means for unlocking the table top is provided on the underside of the table top along each longitudinal side of the table top, and can only be pulled into the disengagement and released position against the force of a spring means for example. Thus, the locking means is finally adjusted into the released position, in such a way that the table top can be pivoted for example from the conventional, generally horizontal use position thereof into an approximately vertical storage position.

However, in the context of the invention a coupling means is now provided between the at least two actuation means and the locking means, and ensures that when an actuation and disengagement means is actuated, the further actuation or disengagement means provided in each case on the opposite table top underside alongside the longitudinal edge is not also moved or adjusted.

For this purpose, in the context of the invention the coupling means is constructed in such a way that when only one actuation means out of at least two provided actuation means is adjusted, only the adjustment brought about by this one actuation means is ever passed on via the coupling means according to the invention to the at least one or preferably two furniture adjustment means, preferably in the form of a locking and release means, the second actuation means which is not adjusted remaining in the starting position thereof, in effect being decoupled.

According to the invention, this can be provided in that when one of the two actuation means is actuated via the so-called primary transmission means which is thus adjusted, the coupling means is acted on in such a way that the secondary transmission means, leading from the coupling means to the at least one furniture adjustment means, is also adjusted and thus the other primary transmission means, proceeding from the other, non-adjusted actuation means and leading to the coupling means, remains unadjusted.

This concept can be provided by various measures within the scope of the invention.

In a preferred embodiment of the invention, this is achieved by two slides, which are coupled to one another by a transmission and coupling means which acts between them. If an actuation and disengagement means is actuated, this causes one slide to be adjusted against the force of a spring means, for example in the longitudinal direction, and causes the secondary transmission means, which engages on said slide for example and is connected to the adjustment or locking means of the table for example, also to be adjusted. The opposite, second slide is also adjusted via the coupling means, and comprises for example a catch decoupling means having a sufficiently long release path that ultimately the second primary transmission means (which thus leads to the second actuation means) is not also adjusted but remains in the starting position thereof without any change.

BRIEF DESCRIPTION OF THE DRAWINGS

The invention is explained in greater detail in the following by way of embodiments, in which, specifically.

DETAILED DESCRIPTION OF THE INVENTION

Figure 1A:
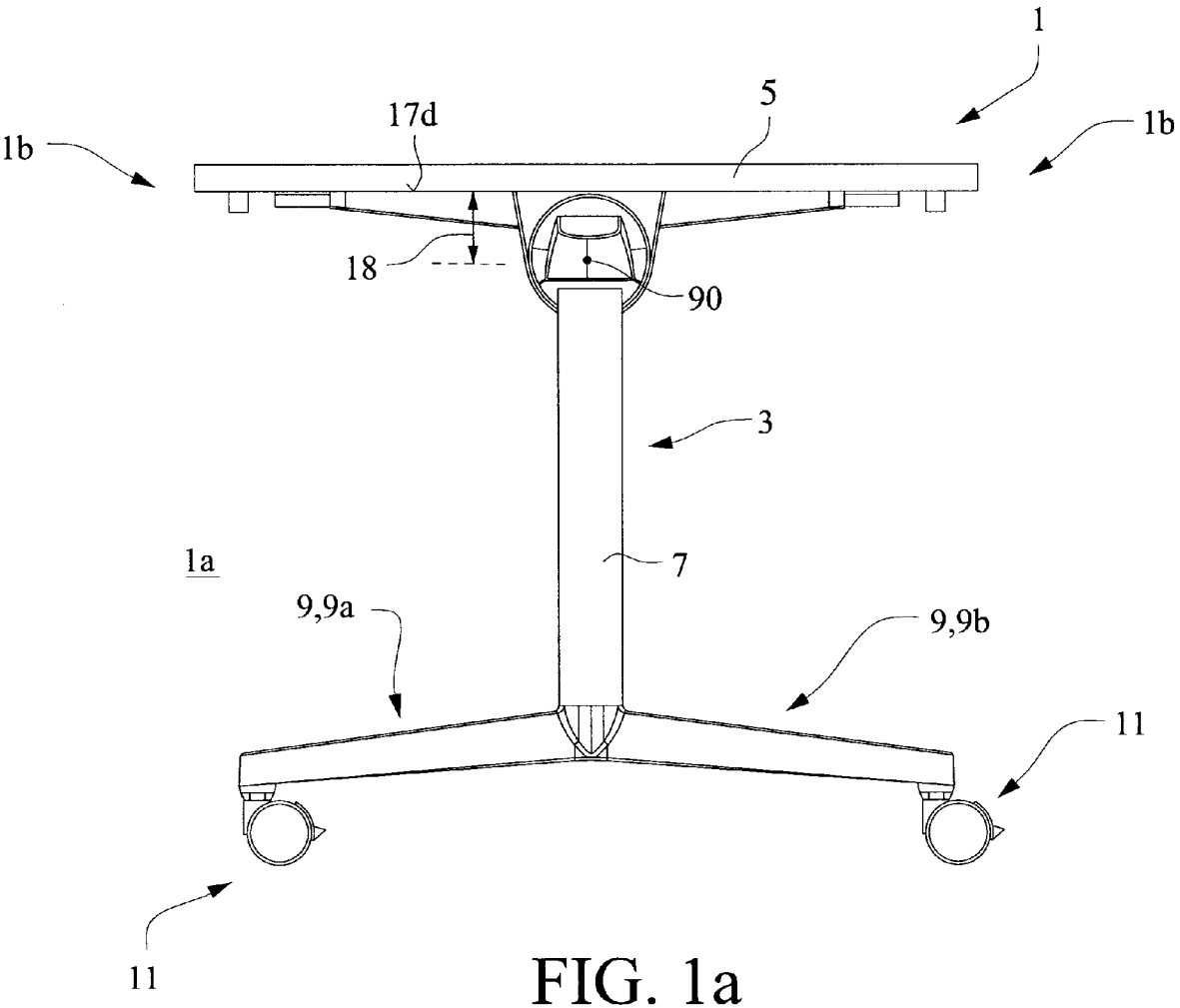
FIG. 1*a* is an end view of a folding table according to the invention.
Figure 1B:
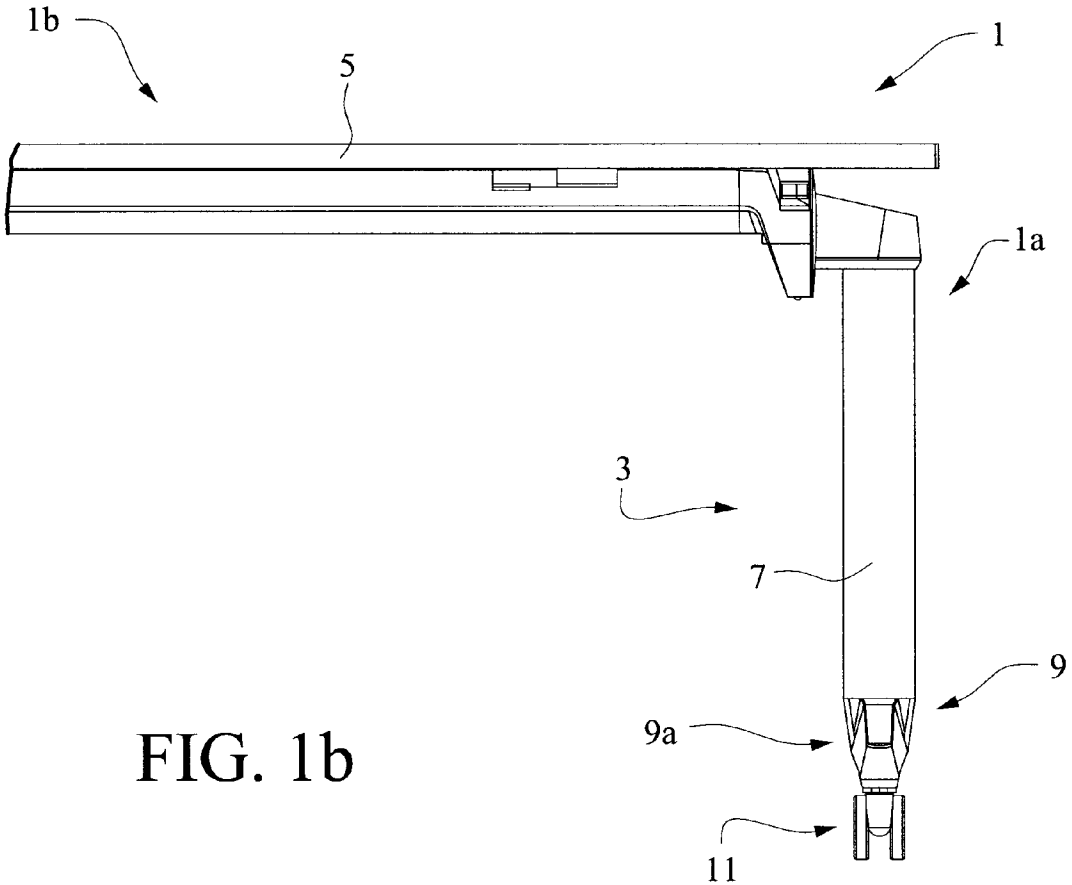
FIG. 1*b* is a longitudinal side view of a detail of the folding table according to the invention, with the support column arrangement arranged at the right-hand end of the table.

FIG. 1*a* shows for example the right-hand end face 1*a* of a folding table 1. FIG. 1*b* is the right-hand part of one longitudinal side 1*b* of the table 1, showing the support means 3 which is arranged on the right in this view.

It can be seen from the drawings that the folding table 1 comprises an upwards-facing table top 5, which in FIGS. 1*a* and 1*b* is located in the generally horizontally oriented work position thereof.

The support means 3 is provided at each of the two opposite end faces 1*a* and in the embodiment shown comprises a respective support column 7, which transitions downwards into a support base 9, which comprises support base portions 9*a* and 9*b* projecting on either side of the support column 7.

A roller arrangement 11 is provided on each of the opposite ends of the support bases 9 and is conventionally provided with a fixing or releasing mechanism. This means that the folding table can be moved for various uses or storage positions without difficulty. In each desired work position it can be ensured, by actuating the locking mechanism integrated into the rollers, that the table is not moved accidentally.

Figure 2:
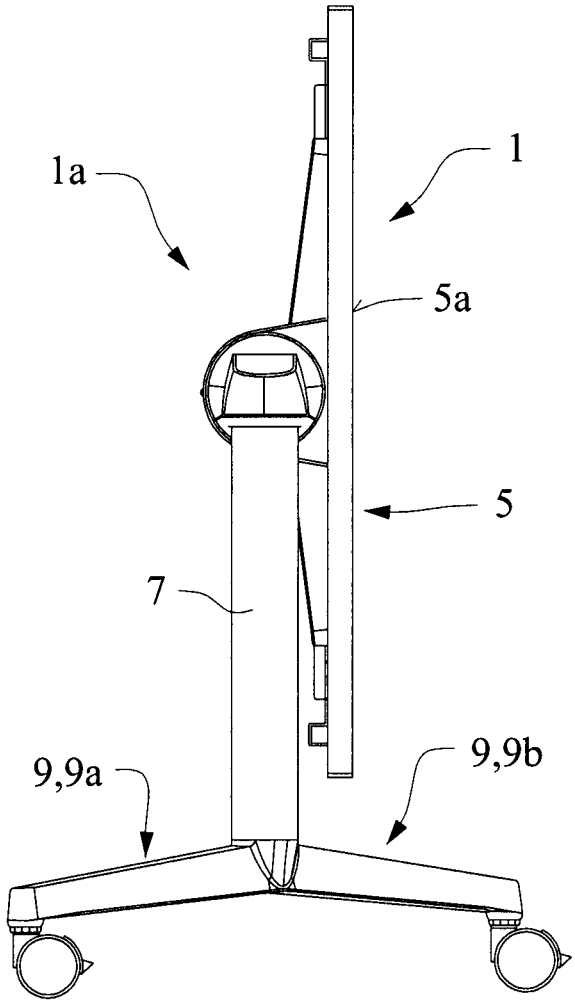
FIG. 2 is an end view, comparable to FIG. 1, of the table according to the invention, in which the table top has been pivoted to the right into the storage position thereof.

FIG. 2 reproduces the right-hand end face 1*a* of the table as shown in FIG. 1, with the table top brought into the vertically extending storage position arranged on the right.

Figure 3A:
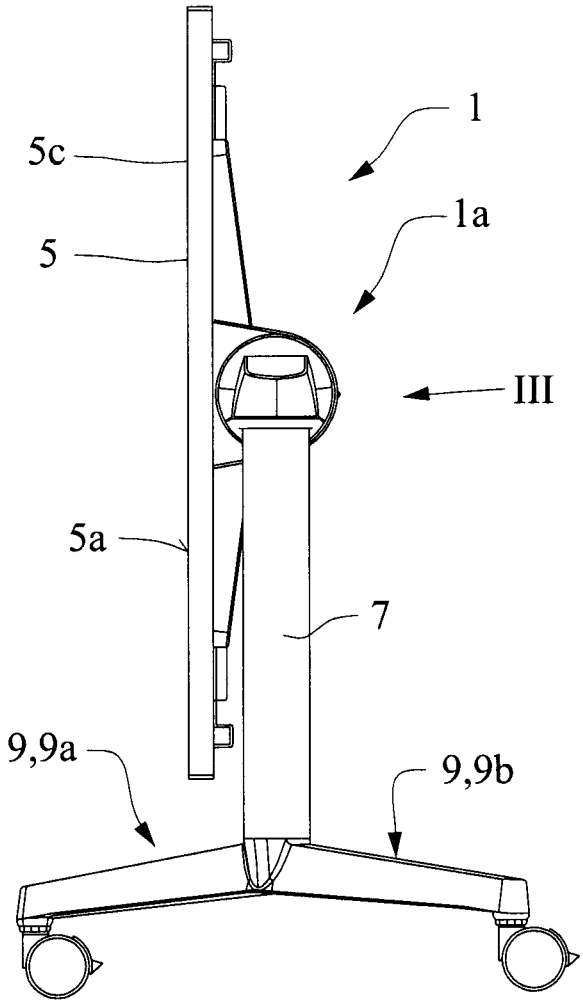
FIG. 3*a* is an end view comparable to FIG. 3*a*, but in which the table top is pivoted into the opposite storage position.
Figure 3B:
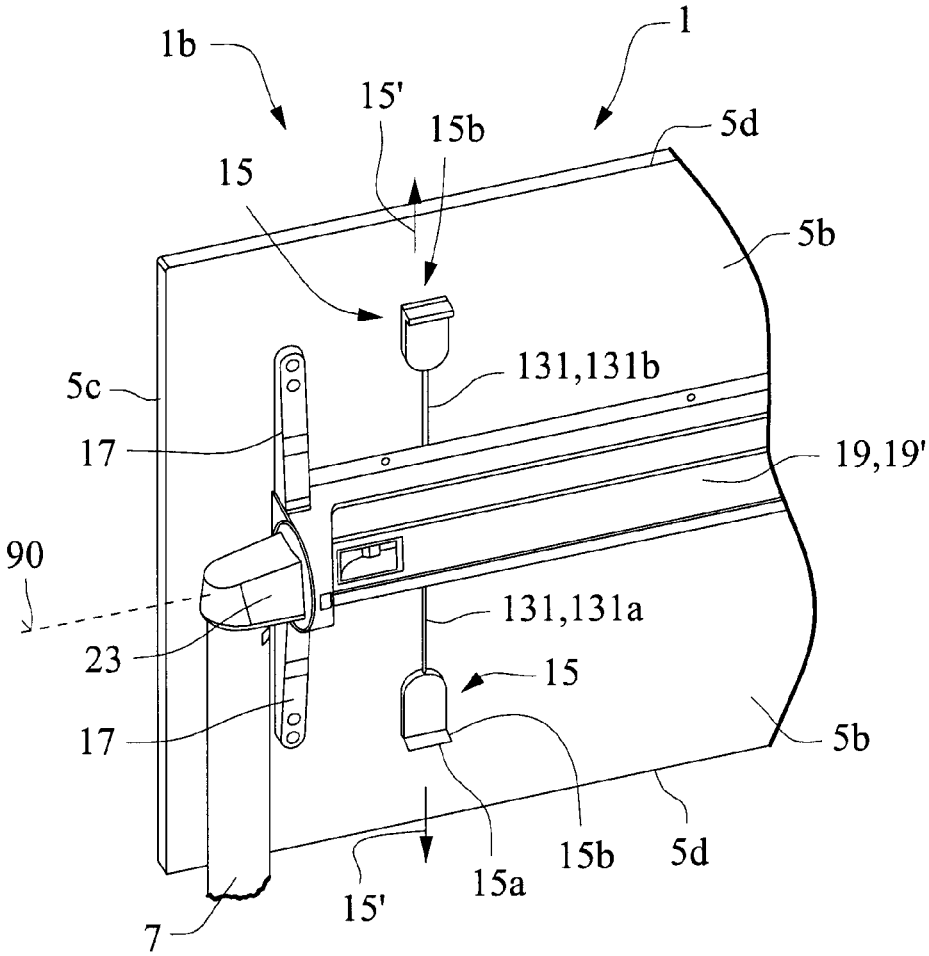
FIG. 3*b* is a rear view of part of the folding table shown in FIG. 3*a* with the work surface folded into the storage position.

In FIG. 3*a*, by contrast with FIG. 2, the table top 5 has been brought into the opposite pivot position, and FIG. 3*b* is a rear view, in the direction of the arrow III shown in FIG. 3*a*, of part of the underside 5*b* of the table top 5 when folded into the storage position.

So that the work surface can be folded into the storage position around a horizontal pivot axis 90 (FIG. 3*b*) from either longitudinal side 1*b* of the folding table 1, a disengagement and/or actuation mechanism 15 is provided on the two opposite longitudinal sides 1*a* of the folding table on the underside 5*b* of the table top 5 (FIG. 3*b*). If this disengagement and/or actuation mechanism 15 is for example pulled in the direction of the arrow 15' towards the adjacent longitudinal edge 5*d* of the table top 5 (specifically by gripping an associated handle portion on the actuation means 15), this releases a locking mechanism (described in greater detail below) in such a way that a table top located in the work position can then be folded into the storage position, pivoted through 90°, thereof or vice versa. It can be seen from FIG. 3*b* that for example two actuation means 15*a* and 15*b* are provided, one actuation means being arranged alongside one longitudinal edge 5*d* and the other actuation means being arranged alongside the opposite longitudinal edge 5*d* on the underside of the table top, in such a way that it is possible from either side to grip a corresponding actuation means 15 and thus to carry out the desired adjustment.

As can be seen from the drawings, a two-armed table top support 17, extending parallel to the end face 5*c* of the table top 5 in the embodiment shown, is provided offset inwardly on the underside 5*b* of the table top 5, in each case in the end face region of the end face 5*c* of the table top 5, and is screwed onto the underside 5*b* of the table top 5 using screws for example.

A trough 19 is fixed to the underside of the table top, between the two two-armed table top supports 17 arranged alongside the end edges 5*c* of the table top 5, and acts as a cable channel 19'.

Figure 4:
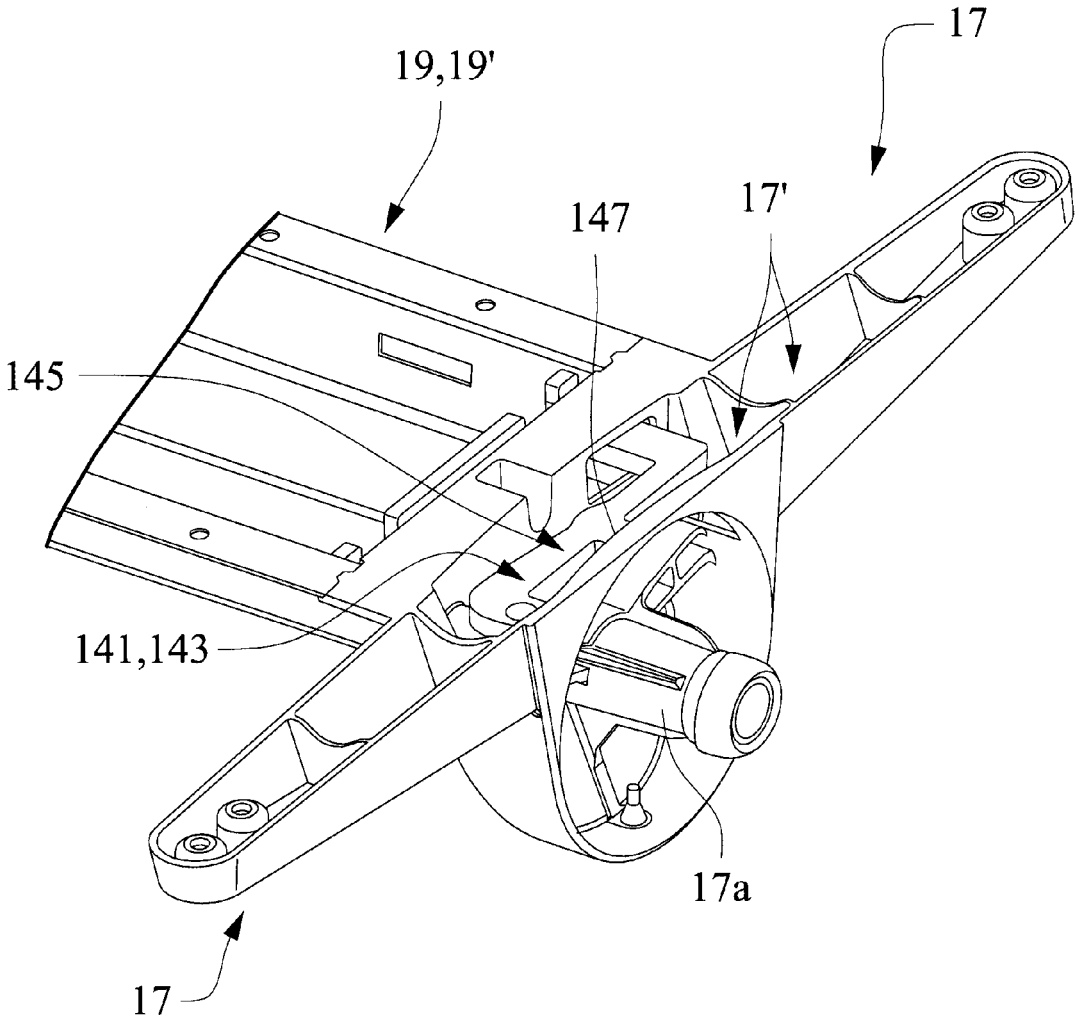
FIG. 4 is a three-dimensional view of a detail of a two-armed table top support having an associated hollow shaft and a mounted bevel gear fixed in rotation therewith, adjacent to a cable channel.

The two-armed table top support 17 transitions—as can be seen in particular from the three-dimensional detail according to FIG. 4—into a hollow shaft 17*a*, which lies at a predetermined distance 18 below the upwards-facing construction plane 17*d* (FIG. 1*a*) of the two-armed table top support 17, the underside of the table top 5 being laid on said plane and fixed to the table top support. The aforementioned distance 18 between the underside of the table top 5 and the horizontal pivot or tilt axis 90 (FIG. 3*b*) extending centrally through the hollow shaft 17*a* is of a sufficient size to travel past the respective stand means in the form of support columns, i.e. past the support columns 7, when the table top 5 is pivoted into one of the two opposed storage positions (in which the table top is suspended oriented more or less vertically).

An axle 21 (FIG. 5) engages in this hollow shaft 17*a* and is braced rigidly in a bracing head 23, which is in turn supported directly on the upper end of the support column 7.

This provides the possibility of the two-armed table top support 17 being pivoted together with the table top 5, in each case around the non-rotating axle member 21 from the upwards-facing, approximately horizontal work position into one of the two mutually opposed storage positions, in which the work surface is oriented more or less in the vertical direction.

The table top is to be locked, at least in the single work position thereof, conventionally in the horizontal position, by a locking mechanism mentioned above, in such a way that pivoting is reliably prevented.

For this purpose, the locking mechanism comprises a furniture adjustment means 141, in the present embodiment specifically in the form of a locking and release means 143, which comprises on the one hand a pivotable locking and/or retaining means 151 having a catch pin 147, and on the other hand a catch means 153, which is formed as a locking disc 153' in the present embodiment.

Figure 5:
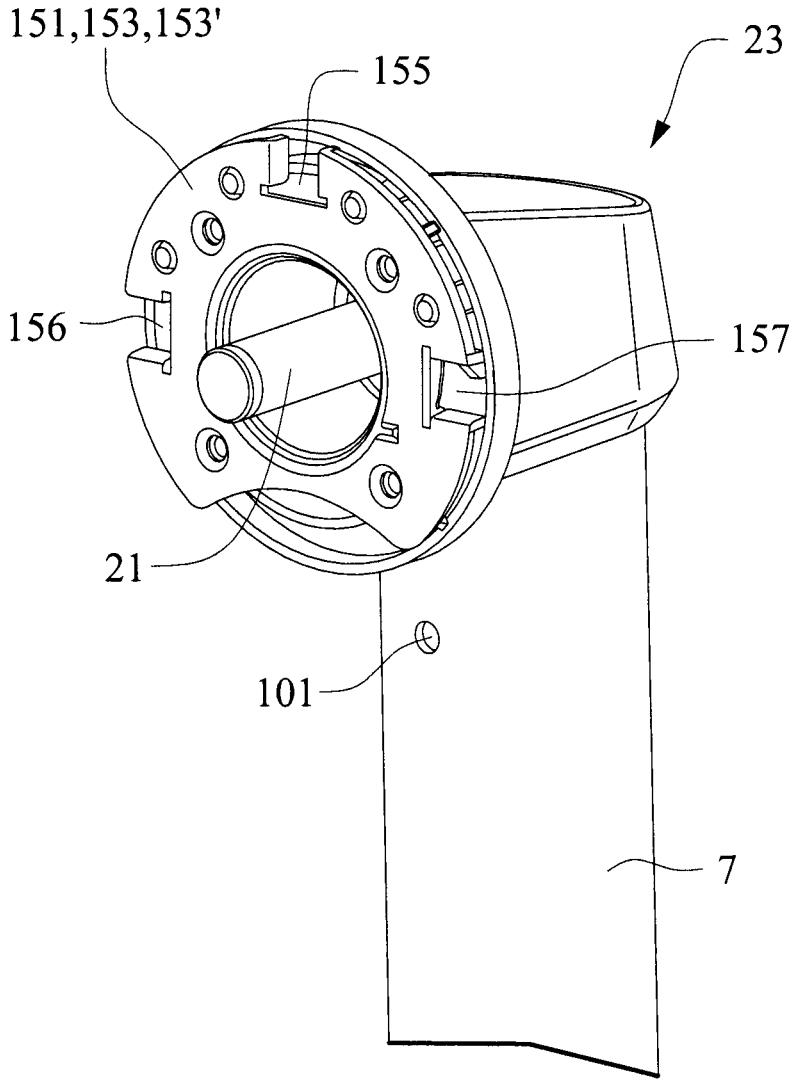
FIG. 5 is a three-dimensional schematic view of a bracing and supporting head with associated ratchet wheel and fixed axle.

As can be seen from FIG. 5, the locking disc 153' comprises three catch recesses 155, 156 and 157, mutually offset in the circumferential direction, the first catch recess 155 being arranged in the vertically upwards-facing position and the catch recesses 156, 157 being arranged in the horizontal position, diametrically opposite relative to the horizontally oriented axle 21.

In the embodiment shown, the locking disc 153' is preferably screwed onto the bracing and retaining head 23 and thus held fixed axially and above all radially. The aforementioned recesses 155, 156, 157 which are offset in the circumferential direction may, depending on the catch position, be penetrated by an axial catch pin 147 (FIG. 4), which is part of the actuation means 141 or is positioned thereon. The actuation means 141 having the locking and release means 143 and having the catch pin 147 which is formed or positioned thereon may for example be held in a recess 17' of the two-armed table top support 17 so as to be displaceable and pivotable.

The following figures schematically show a coupling means 51 according to the invention for adjustable parts of pieces of furniture, for example for actuating a locking and release means 143 on a table with a pivotable table top 5.

Figure 6:
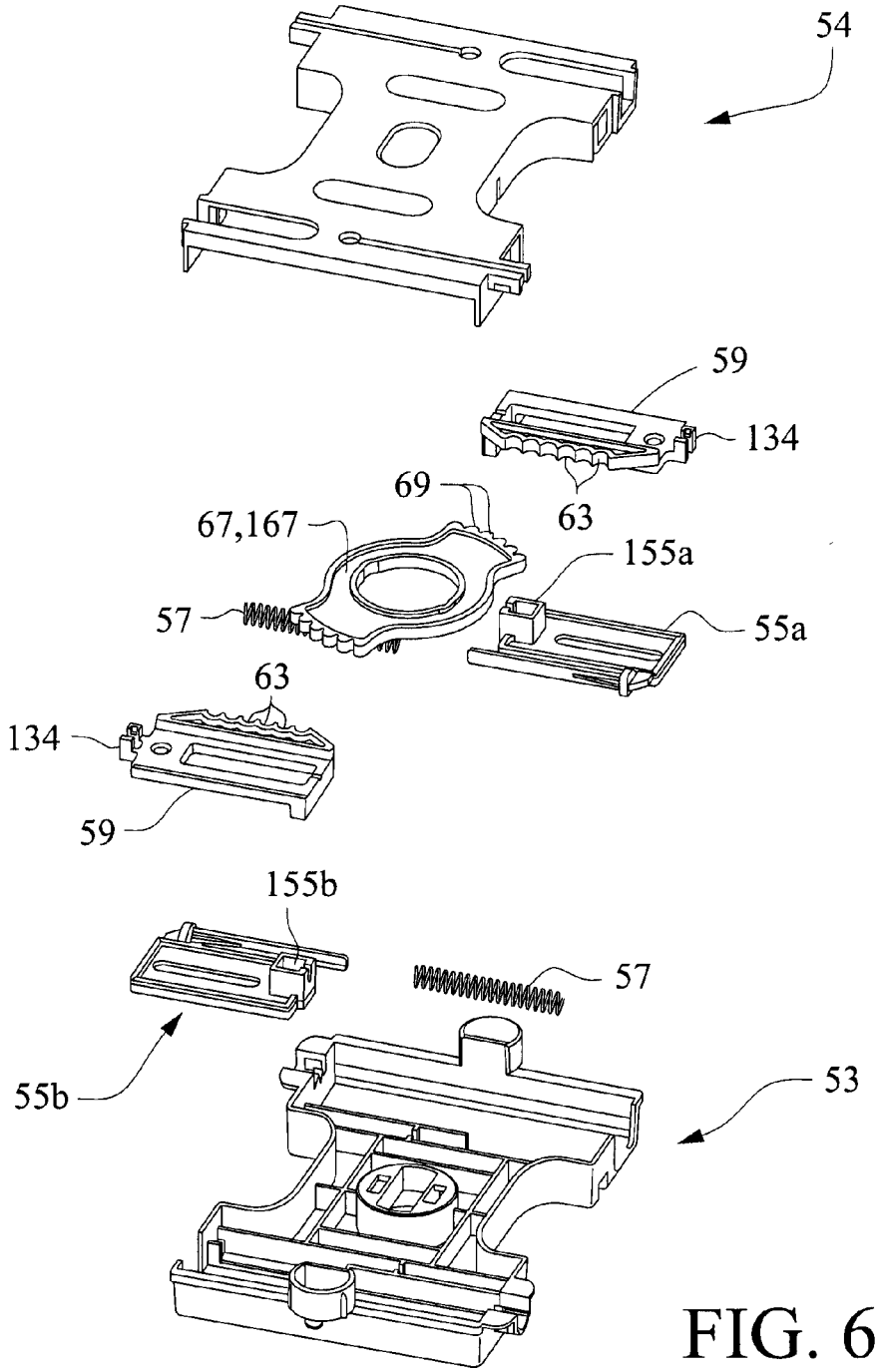
FIG. 6 is an exploded view of all of the relevant parts of the coupling means according to the invention.

Thus, FIG. 6 is a perspective, exploded view of an arrangement of the coupling means, together with an adjustment housing 53, an adjustment housing lid 54, and various adjustable components installed inside the housing.

Figure 7:
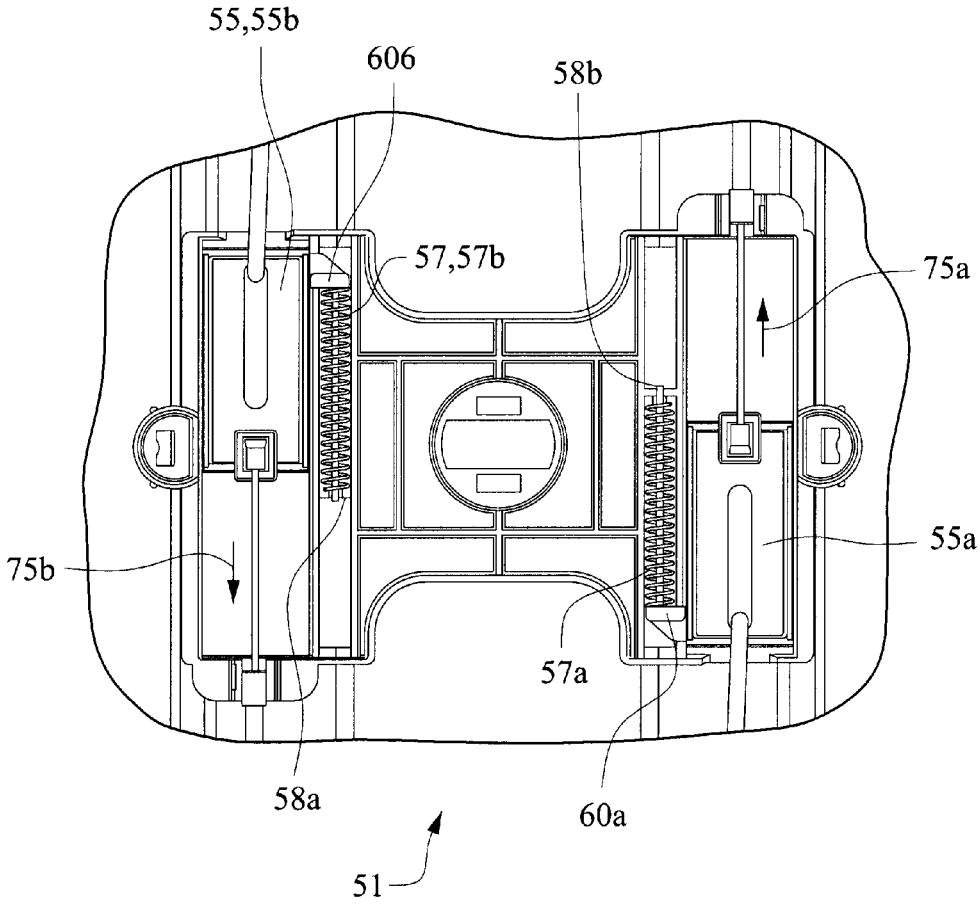
FIG. 7 is an enlarged detail of the coupling means according to the invention, omitting the coupling housing lid and other components.
Figure 8:
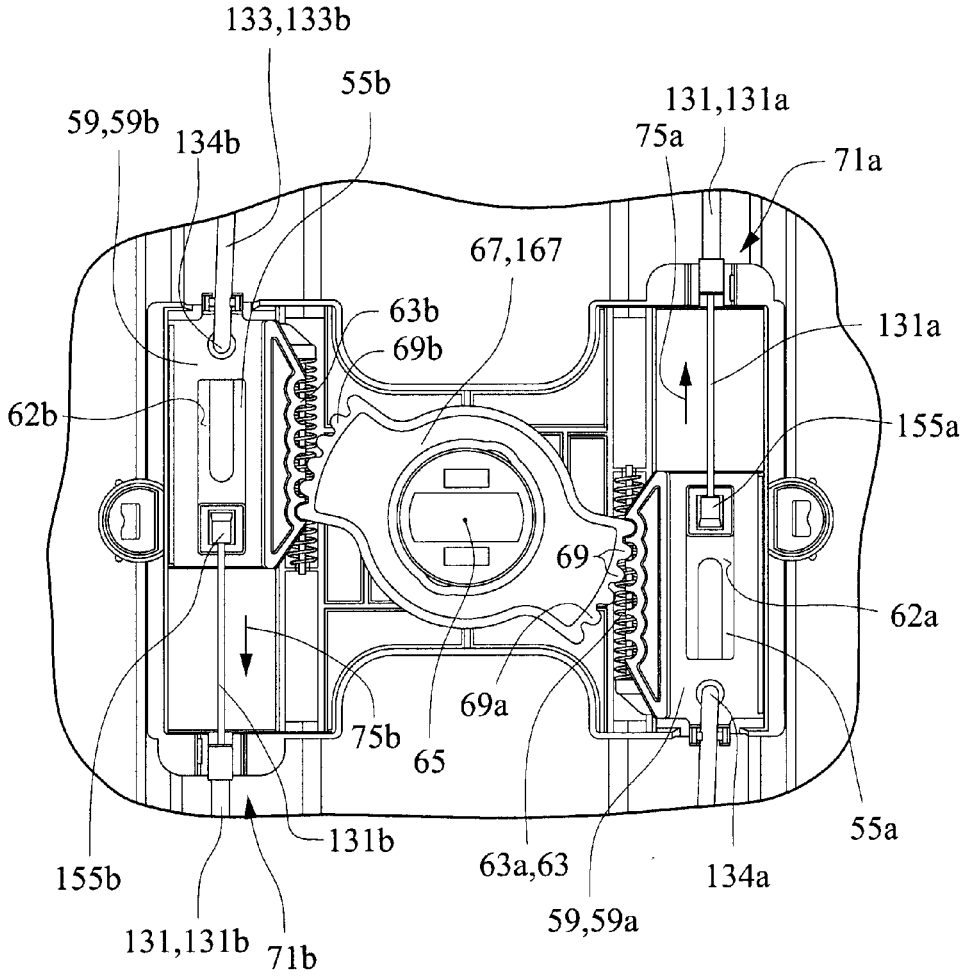
FIG. 8 is a view corresponding to FIG. 7, in which further components associated with the coupling means are also incorporated, such as two parallel slides and a coupling transmission means.
Figure 9:
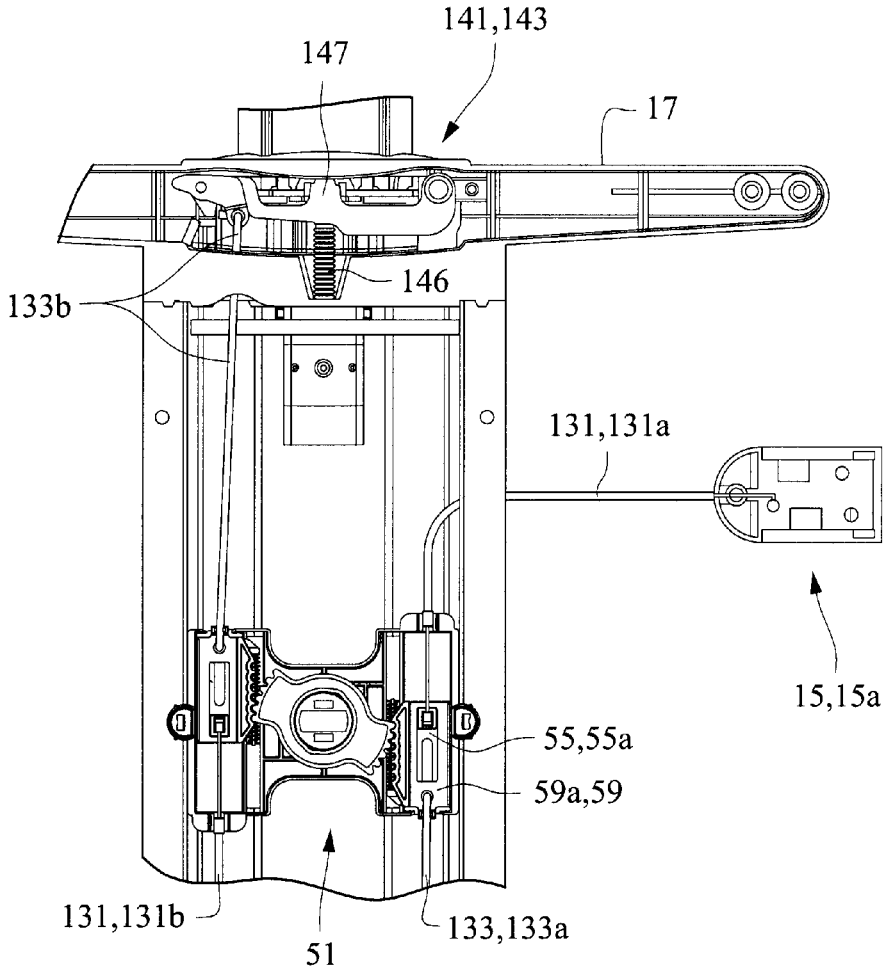
FIG. 9 is a detail of the coupling means according to the invention and an actuation member attached to said coupling means as well as a locking and release means, in the basic, starting position, which is actuated via the coupling means.

FIGS. 7 to 9 follow, and show the basic construction, further to the exploded view of FIG. 6.

It can be seen from the drawings that the coupling means 51 in the embodiment shown comprises two adjustment slides 55, i.e. 55*a* and 55*b*, arranged mutually transversely offset and oriented mutually parallel, in the adjustment housing 53 shown in part (shown when open) in FIG. 7.

Each adjustment slide 55 is held biased, by a spring means 57, into the single basic, starting position thereof, which it adopts when an actuation means 15 is not pulled out. Each spring means 57*a* or 57*b* is supported on the one hand against a stop 58*a* or 58*b* which is fixed to the housing and on the other hand against a stop 60*a* or 60*b* which moves together with the respective adjustment slide 55, and is therefore biased towards compression.

As can be seen by comparing FIG. 7 and FIG. 8, a parallel slide 59 is provided in the region of each adjustment slide 55*a*, 55*b*, and comprises a longitudinal recess 62*a* or 62*b*, a catch decoupling means 155*a* engaging in or penetrating through said recess, this catch decoupling means 155*a* in each case being formed on or fixed to the associated adjustment slide 55*a* or 55*b*. In the embodiment shown, this catch decoupling means 155*a* or 155*b* is of a square shape in a plan view.

Each parallel slide 59*a* or 59*b* is guided by longitudinal displacement in the corresponding housing recess of the adjustment housing 53 and/or on the associated adjustment slide 55, specifically taking into account the following particulars.

Each of the two parallel slides 59 is provided on the side facing the other with a toothed extension 63, i.e. with ribs 63, a transmission member 67 being arranged in the middle so as to be rotatable about a central axis 65 and also being equipped externally over part of the circumference thereof with a toothed extension 69, one toothed extension 69*a* engaging, i.e. interlocking, with one toothed extension 63*a* on one parallel slide 59*a*, and the other toothed extension 69*b* on the transmission member 67 engaging, i.e. interlocking, with the other toothed extension 63*b* on the other parallel slide 59*b*.

As was shown previously in FIG. 3*b*, a first and a second actuation means 15*a* and 15*b* are provided, and are each connected to the coupling means 51 via a primary transmission means 131, for example in the form of a Bowden cable (or another suitable means). In other words, one actuation means 15*a* is connected via one primary transmission means 131*a* and the second actuation means 15*b* is connected via the second primary transmission means 131*b* to two different points on the coupling means.

It can thus be seen from the plan view of FIGS. 7 and 8 that the primary transmission means 131*a* coming from the first actuation member 15*a* and leading to one adjustment slide 55*a* leads via the associated entrance face 71*a* on the adjustment housing 51 to this one adjustment slide 55*a* and is rigidly braced to a bracing point 155*a* located there. The second actuation means 15*b* is connected to the second adjustment slide 55*b* via the second transmission means 131*b* coming through the second entrance face 71*b*, specifically at a second bracing point 155*b*, these bracing points 155 forming the so-called catch decoupling means 155 in the embodiment shown.

Figure 10:
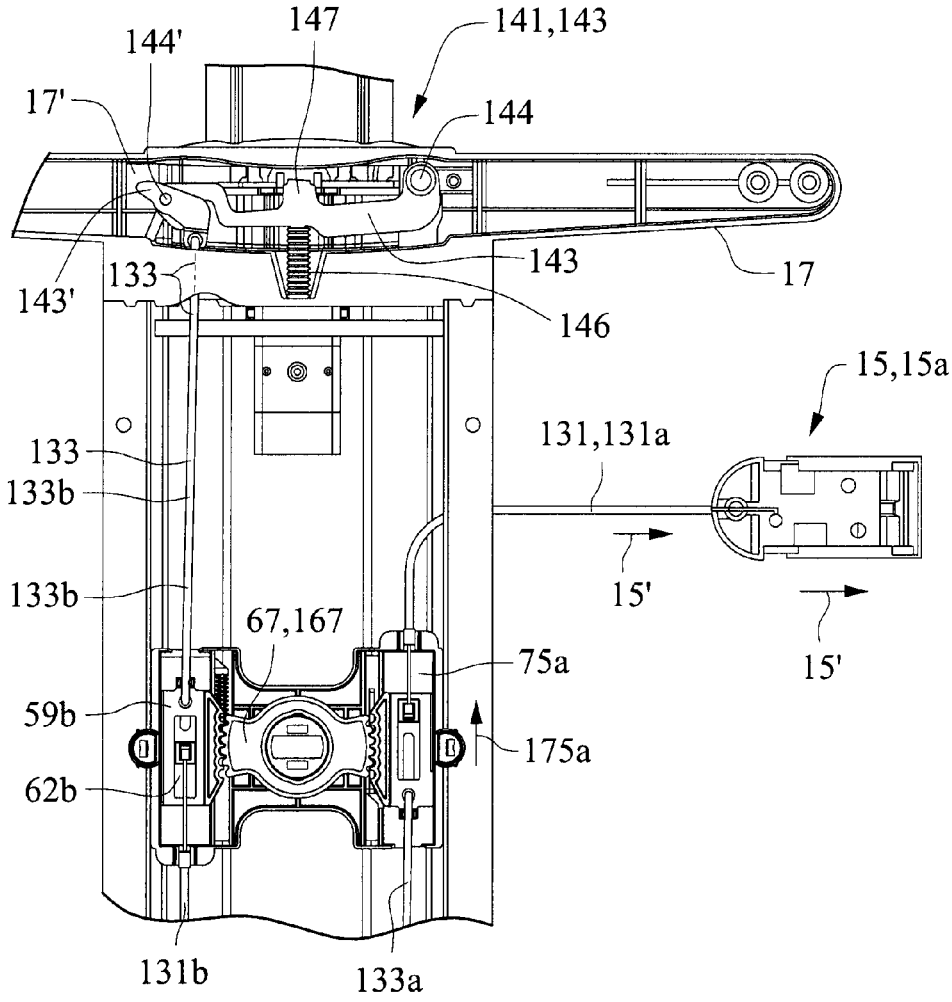
FIG. 10 is a view corresponding to FIG. 9, in which the coupling means is located in an intermediate position.
Figure 11:
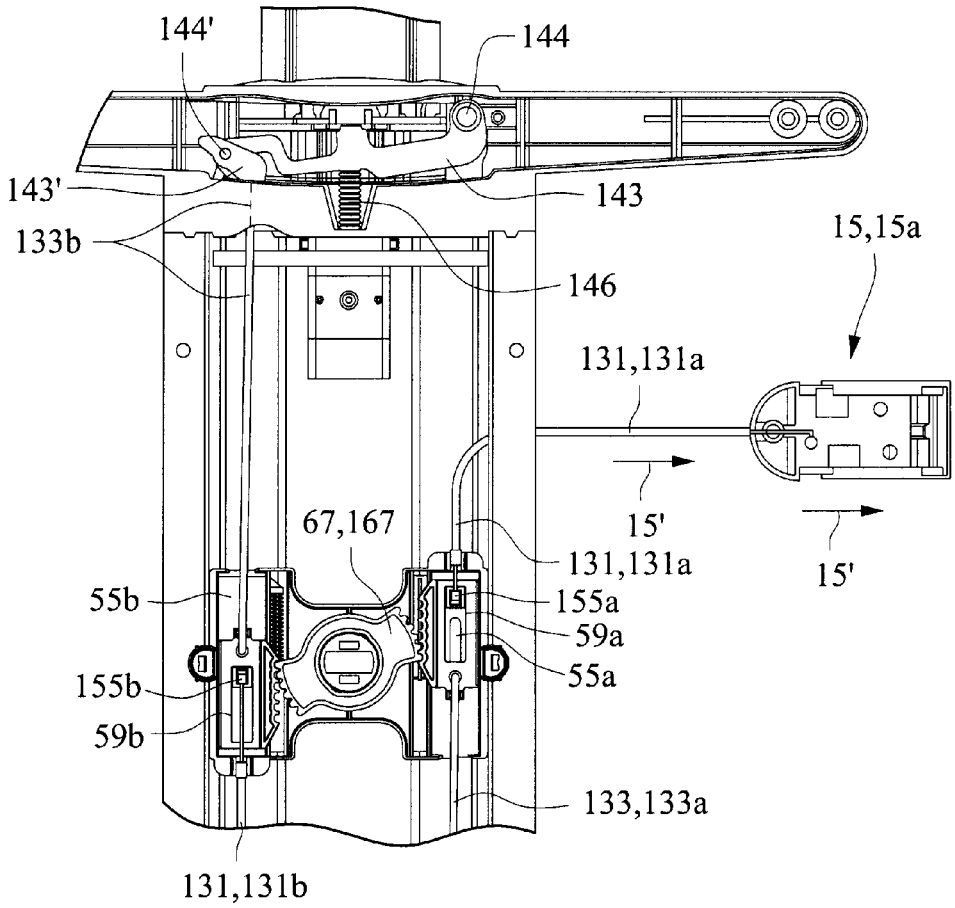
FIG. 11 is another further view corresponding to FIGS. 9 and 10, but with the coupling means fully pivoted in an end position opposite the starting position, with the locking means released.

As can be seen from the remaining FIGS. 9, 10 and 11, the coupling means 51, i.e. the parallel slides 55*a* and 55*b*, are connected via a further, i.e. secondary transmission means 133 to an associated furniture adjustment means 141, in the form of a locking and release means 143 in the embodiment shown. Thus, the remaining FIGS. 9, 10 and 11 show the coupling means 51, at least together with one actuation means 15*a* and the associated primary transmission means 131*a*, the second primary transmission means 131*b* coming from the second actuation means 15*b* only being shown in part. The associated secondary transmission means 133*a* and 133*b* now engage on the aforementioned, mutually opposed faces of the associated parallel slides 59*a*, 59*b*, and lead both to the locking and release means 143 leading along one end face of the adjustable table and to a second locking and release means 143 provided on the opposite end face of the table having the adjustable table top (FIGS. 9 to 11 only showing or indicating the locking and release means 143 provided on one end face).

In other words, the secondary transmission means 133*a* and 133*b* are fixed to the relevant associated parallel slide 59*a* or 59*b* at fixing points 134*a* and 134*b*.

The operation will be discussed in greater detail in the following.

If for example one actuation means 15*a* on the underside of the table top alongside the respective longitudinal side 5*d* is pulled in the direction of the arrow 15', then the associated transmission means 131*a* (in this case in the form of a Bowden cable, although it is of course also possible for a different force transmission and adjustment means to be provided) is also pulled out, in such a way that the associated adjustment slide 55*a* is adjusted against the force of the spring means 57, 57*a* towards the opposite adjustment position thereof in the adjustment housing 53, i.e. on the adjustment path 75*a* thereof in the direction of the arrow 175*a* (FIG. 10). Because the catch 155*a*, which penetrates through the aforementioned longitudinal recess 62*a* in the parallel slide 59*a*, is formed on the adjustment slide (the catch 155*a* simultaneously representing the bracing position 56*a* for the first actuation and disengagement means 131*a*), the parallel slide 59*a* is thus also adjusted via the adjustment slide 55*a* from the starting position thereof shown in FIG. 9 through the intermediate position thereof shown in FIG. 10 into the end position thereof shown in FIG. 11. The parallel slide is also entrained because the catch 155*a* penetrates through the longitudinal recess 62*a* at the end of said longitudinal recess 62*a* and, when tensioned via the aforementioned actuation and disengagement means 131*a*, is supported directly against the delimiting stop of the longitudinal recess 60*a* and thus also adjusts the parallel slide 59*a*.

Because the adjustment and transmission means 133*a*, which leads to one locking and release means 143 on one end face of the table, engages on the opposite end of the parallel slide 59, it accordingly adjusts a locking mechanism (for example a locking lever described further below) from the locked position into the released position thereof.

However, it can also be seen from FIGS. 9 and 10 that the adjustment (i.e. displacement) of the parallel slide 59*a*, via the toothed extensions 63 formed internally thereon, also rotates the transmission means 67 which on the opposite side thereof is in engagement with the further parallel slide 59*b* via the toothed engagement which is present there. In this way, the second parallel slide 59*b* located on the opposite side is also adjusted into the opposite position, by contrast with FIG. 6, on the adjustment path 75*b* thereof. Because the second secondary transmission means 133*b*, which leads to the second release and locking means 143 (which is provided on the end face, shown in FIGS. 9 to 11, of the table for unlocking and pivoting the table top), also engages on one end of this parallel slide 59*b* which is also adjusted, the two locking and release means 143 provided on the two opposite end faces of the table are only pivoted into the released position by pulling on an actuation member 15*a*.

However, in this operation, despite the adjustment of the second parallel slide 59*b*, this second adjustment slide 55*b* has been held undisplaced because of the force of the spring means 57*b* acting on it. This is also because the slit 62*b* in the second parallel slide 59*b* is sufficiently long that the catch decoupling means 155*b* projecting through this slit 59*b* can dip into this slit without interacting with the delimitations at the ends of the slit and remain undisplaced in the starting position thereof. Thus, the primary transmission means 131*b* which is connected to the second actuation means 15*b* via the second adjustment slide 55*b*, and thus the associated actuation means 15, 15*b* are also not adjusted.

If the aforementioned first actuation means 15*a* is released again, then for example the spring means 57*a*, which presses against the first adjustment slide 55*a* (for example also via a further spring means 146, described further below, provided in the respective locking means), is displaced back into the starting position thereof shown in FIG. 9. Thus, the transmission means 67 is also pivoted back and the second parallel slide 59*b* is also guided back into the starting position thereof without the adjustment slide 55*b* moving.

If for example the second actuation means 15*b* were then actuated, starting as in FIG. 9, the parallel slide 59*b* on the left in FIG. 9, and via the catch 155*b* also the parallel slide 59*b*, would thus be adjusted into the opposite adjustment position. In this way, the second secondary transmission means 133*b* is also pulled out directly and the locking and release means 143 connected thereby is adjusted into the released position. However, the first parallel slide 59*a* is also adjusted (now without the first adjustment slide 55*a* moving) into the pulled-out position thereof via the aforementioned transmission means 67 and the toothed engagement with the first parallel slide 59*a*, also pulling out the secondary transmission means 133*a* which is connected to this parallel slide and which leads to the first locking and release means 143 and adjusts said means into the released position.

The advantage of this arrangement is thus still that when an actuation means is pulled out, the respective other actuation means 15 is always decoupled, i.e. not automatically also adjusted.

If, for example, only a single actuation means for furniture, for example only one locking and release means 143, is provided, then only one adjustment transmission means 133 is positioned on the aforementioned adjustment means 51 and is for example connected either to the first parallel slide 59*a* or to the second parallel slide 59*b*.

In the following, for completeness, one of a number of possible locking and release means 143 will be described briefly by way of the drawings.

As can be seen from FIGS. 9 to 11, the locking and release means 143 comprises for example a locking lever 143', which is pivotable about an axis 144 and comprises a locking pin 147, which latches into a fixed latch recess 55, for example 55*a* (FIG. 5), and is in particular acted on by the force of the aforementioned spring means 146.

In the embodiment shown a lever transmission is also provided, i.e. a second locking lever 143' of smaller dimensions is articulated about a further pivot axis 144' in the region of the free end of the first locking lever 144, the aforementioned adjustment and transmission means 133 then being positioned on this second locking lever 143' and being connected to a respective associated first or second parallel slide 59*a*, 59*b*. If, as mentioned above, the adjustment means 51 is accordingly adjusted by actuating an actuation means, then the two aforementioned adjustment transmission means 133*a*, 133*b* are pulled out and thereby the associated catch pins 147 are slid out from the respective catch recesses 55 by the two locking levers, in such a way that the table top support 17 is then freely pivotable together with the associated table top 5 about a horizontal axis 90, for example into the approximately vertically oriented storage position thereof. If the actuation means is released again, then the respective catch pin is slid back into a catch recess 55 by the spring means 57 in the adjustment means 51 and also by the additional spring means 146 on the locking and release means 143, if located in the direct extension of this catch pin 147 when the table top is correspondingly extended (in the horizontal or for example vertical direction).

Figure 12:
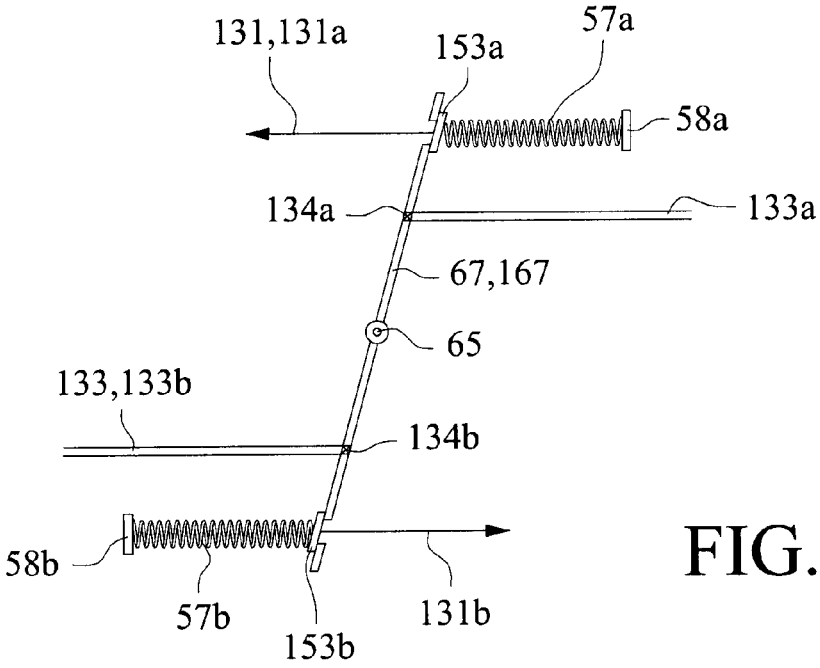
FIG. 12 is a schematic view of a further basic example of a configuration according to the invention of a coupling means according to the invention in the basic, starting position thereof.
Figure 13:
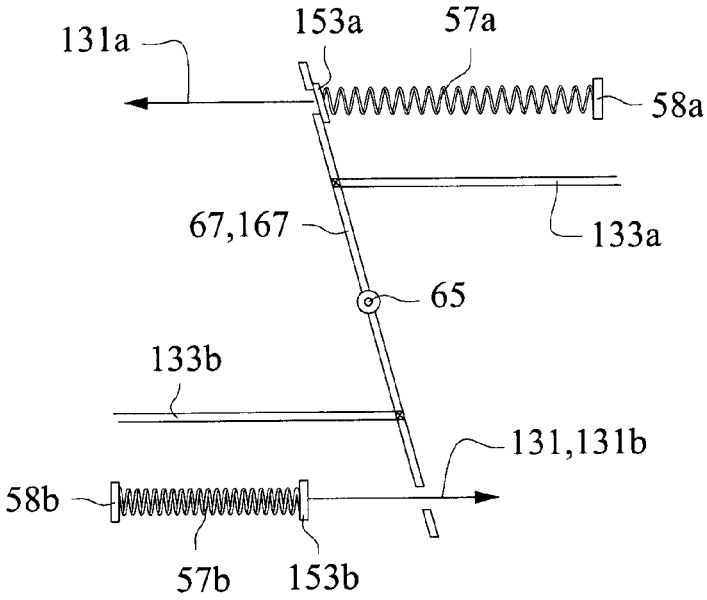
FIG. 13 is a view corresponding to FIG. 12 with the coupling means adjusted into the two end positions.

A further, simplified principle for an adjustment means according to the invention is discussed by way of FIGS. 12 and 13.

From the basic drawing of FIG. 12, it can be seen that in this case too a transmission means 67 is provided for example in the form of a transmission means 67 pivotable about a central axis 65, and said means will also sometimes be referred to as a coupling means 167 in the following. One of the two adjustment and transmission means 133*a* and 133*b* of this coupling means 167 which lead to the respective locking and release means 143 is in each case positioned on one of two opposite points, offset relative to the central axis 65.

If for example the transmission means 131*a* shown at the top, leading to one actuation means 15*a*, is now pulled, then the transmission and coupling means 67, 167 in the form of a double lever is also rotated anticlockwise from the position shown in FIG. 12 into the position shown in FIG. 13 by the catch 153*a*, in this way, the two secondary transmission means 133*a* and 133*b* leading to the locking and release means 143 are also entrained and pulled out, since these adjustment and transmission means are rigidly connected to the transmission and coupling means 67, 167 at the fixing points 134*a* and 134*b*.

It is thus preferred in each case for a relevant catch 155 or the relevant transmission means 131 also to be acted on by the force of one of the aforementioned spring means 57*a* and 57*b* (specifically, in the tension or compression direction depending on the support point, the spring means being biased under tension in the assignment according to FIGS. 12 and 13), in such a way that when the actuation means 15 is released, this spring means pivots the entire adjustment means 51 back into the basic position thereof shown in FIG. 12.

However, for the adjustment process described, triggered by the actuated actuation means 15*a*, it can be seen in the drawings, in the transition from FIG. 12 to FIG. 13, that although the catch 153*a* (which is pulled out by the actuation means 15*a*) does pivot in correspondence with the transmission and coupling means 67, 167, the opposite catch 153*b* simultaneously remains held in the starting position thereof by the spring means 57*b* thereof, since the opposite catch 153*b* is simultaneously decoupled from the rotated transmission and coupling means 67, 167. In other words, the construction is of a type such that although the transmission and coupling means 67, 167 is rotated anticlockwise when the respective transmission means 131*a*, 131*b* is adjusted, rotation of the coupling means 67, 167 nevertheless retains the catch 155, which is connected to the non-actuated transmission means 131*a* or 131*b*, in an undisplaced manner in its shown starting position and in this way the respective second transmission means 131, which is not acted on, and thus the associated second actuation means 15 remain in the starting position thereof.

In other words, FIGS. 12 and 13 only show in a simplified manner that with tensile loading an entrainment effect is present to the extent that the force introduced via the actuation and disengagement means leads to pivoting of the coupling means and thus of the transmission means 67, 167, but that this pivoting movement retains the non-actuated, non-adjusted transmission means 131 in an unpivoted manner in the starting position thereof because of the spring effect present thereon.

Further modifications are possible in this context.

In this embodiment too, if only one locking and release means 143 is disengaged, then only one of the two secondary transmission means 133*a* or 133*b* is omitted.

The invention claimed is:

1. Adjustment means, which can be pivoted, locked and released via a locking and release means, of a table, and including coupling means, the adjustment means comprising:

at least two actuation means via which at least one furniture adjustment means can be actuated indirectly, the at least two actuation means are each connected, via a primary transmission means associated therewith, to the coupling means, the coupling means is connected via at least one secondary transmission means to the at least one furniture adjustment means, when at least one of the at least two actuation means is actuated, the coupling means can be adjusted via a corresponding one of the primary transmission means in such a way as to adjust the at least one secondary transmission means and thereby the furniture adjustment means, the coupling means comprises a transmission and sub-coupling means, the transmission and sub-coupling means are constructed in such a way that the at least one secondary transmission means is always adjusted whether one of the primary transmission means is actuated or whether another of the primary transmission means is actuated, and at least two catch decoupling means are provided in such a way that when a corresponding one of the primary transmission means is adjusted, and disengaged by an adjustment of a corresponding one of the at least two actuation means, the transmission and sub-coupling means are always also entrained and adjusted, while one of the catch decoupling means cooperates with the transmission and sub-coupling means in such a way that the adjusting or pivoting transmission and sub-coupling means leave a second secondary transmission means and/or the second actuation means unchanged in position, wherein the coupling means comprises two parallel slides which are diametrically opposed about a central axis and which are adjustable on an adjustment path, one of the secondary transmission means being positioned on one parallel slide and another of the second secondary transmission means being positioned on the other parallel slide, wherein on each of two of the adjustment paths, an adjustment slide is adjustable along the adjustment path against the force of a spring means and is provided with the at least two catch decoupling means in such a way that an adjustment of the adjustment slide also adjusts the coupled parallel slide via the at least two catch decoupling means.

2. Adjustment means according to claim 1, wherein one or two of the secondary transmission means are positioned directly or indirectly on the transmission and sub-coupling means and lead to one or two furniture actuation means.

3. Adjustment means according to claim 1, wherein the transmission and sub-coupling means comprise a double lever, which is adjustable about a central axis, one of the secondary transmission means being positioned offset from the central axis on one side of the transmission and sub-coupling means and another of the secondary transmission means being positioned on the opposite side of the central axis.

4. Adjustment means according to claim 1, wherein each of the catch decoupling means is constructed in such a way that if only one of the actuation means is actuated, causing adjustment of the associated adjustment slide and parallel slide and thereby causing adjustment of the transmission and sub-coupling means, then the second parallel slide is also adjusted, whilst the adjustment slide cooperating with the parallel slide is held by the spring means so as to remain in a starting position thereof.

5. Adjustment means according to claim 1, wherein the parallel slides are provided on mutually facing inner faces thereof with a toothed extension or ribs, which interlock with corresponding teeth or ribs on an outer circumference of the transmission and sub-coupling means.

6. Adjustment means according to claim 1, wherein in each adjustment slide one of the catch decoupling means penetrates or dips into a slit and in doing so is positioned in such a way that the catch decoupling means entrains the associated parallel slide during adjustment movement, whilst an adjustment movement, introduced by the transmission and sub-coupling means, of the parallel slide adjusts the parallel slide relative to the adjustment slide, while the catch decoupling means dipping into the slit remains unadjusted.

7. Adjustment means according to claim 1, wherein the catch decoupling means engages the transmission and sub-coupling means on a side opposite a corresponding one of the primary transmission means in a disengagement and pulling direction and, with tensile loading, adjusts the transmission and sub-coupling means, an adjustment of the transmission and sub-coupling means being disengaged by another of the primary transmission means leaving the associated catch decoupling means in a starting position.

* * * * *